United States Patent [19]

Pollhammer et al.

[11] Patent Number: 4,571,974

[45] Date of Patent: Feb. 25, 1986

[54] BENDING MACHINE FOR WIRE OR STRIP MATERIAL

[75] Inventors: Edgar Pollhammer; Klaus Ritter; Gerhard Ritter, all of Graz, Austria

[73] Assignee: EVG Entwicklungs- u. Verwertungs-Gesellschaft mbH, Graz, Austria

[21] Appl. No.: 609,738

[22] Filed: May 14, 1984

[30] Foreign Application Priority Data

May 18, 1983 [AT] Austria ..... 1829/83

[51] Int. Cl.[4] ..... B21D 7/02

[52] U.S. Cl. ..... 72/217; 72/219; 72/387

[58] Field of Search ..... 72/387, 307, 217, 219, 72/214, 215, 216, 218

[56] References Cited

U.S. PATENT DOCUMENTS

| | | | |
|---|---|---|---|
| 3,299,681 | 1/1967 | Hautau | 72/157 |
| 3,680,347 | 8/1972 | Schenck et al. | 72/217 |
| 3,742,749 | 7/1973 | Bondarenko et al. | 72/217 |

FOREIGN PATENT DOCUMENTS

| | | | |
|---|---|---|---|
| 322324 | 5/1975 | Austria | 72/217 |
| 126321 | 9/1980 | Japan | 72/217 |

*Primary Examiner*—Daniel C. Crane
*Assistant Examiner*—David B. Jones
*Attorney, Agent, or Firm*—Marmorek, Guttman & Rubenstein

[57] ABSTRACT

A wire or strip bending machine has bending tools (1,2), each of which can act as an active tool or mandrel, mounted on an arm (3) which is slidable in a slot (11) in a rotatable disc (10). The disc is rotatable via gearing (13,14) to rotate one of the tools about the other, to bend material between the tools.

7 Claims, 5 Drawing Figures

BENDING MACHINE FOR WIRE OR STRIP MATERIAL

The invention relates to a bending machine for wire or strip material and having two cylindrical bending tools, either of which can be selected to act as an active bending tool which is pivotable about the position of rest of the other tool, which then acts as a bending mandrel. Such a machine is hereinafter referred to as of the kind described.

Such bending machines are known, and offer the advantage that wire or strip material can be bent in a choice of directions in the same plane, that it is to say both clockwise and counter clockwise out of its direction of advance.

In the case of a bending machine of the kind described, which is known from U.S. Pat. No. 3,680,347, two bending rollers are rotatably arranged on a circular baseplate provided with external teeth. Journal pins of the bending rollers project on the opposite side of the baseplate and can alternately rest in an assigned one of two semi-cylindrical step bearings. Depending on the direction of advance of a rack which engages in the teeth of the baseplate, one of the two step bearings acts as a pivot axis, and the roller assigned to this pin forms the bending mandrel about which the material is bent, while the other roller is pivoted about this bending mandrel and forms the active bending tool for bending the wire.

In the case of this bending machine the pivot axis of the particular bending roller which is active is offset relative to the axis of rotation of the baseplate, so that no linear relationship exists between the distance covered by the driving rack and the angle of bending. In order to bend at angles of varying magnitude, as desired, a machine of this type must therefore be equipped with a complicated electronic control device which takes into account the functional relationship between rack travel and angle of bending. Moreover, bending machines of this type are also difficult to convert for the bending of wires of different diameter, since the necessary distance apart of the journal pin axes for satisfactory bending operations is dependent on the diameter of the wire, which not only requires a plurality of parts to be exchanged during the conversion but, additionally, dictates another functional relationship between rack travel and angle for every diameter of wire.

A further bending machine of the kind described is known from Austrian Pat. No. 322,324. In this machine, one of the two bending tools is located on the central axis of a circular disc which is mounted so as to be eccentrically rotatable within a larger disc, whereas the other bending tool is arranged eccentrically on the smaller disc, but centrally with respect to the larger disc. Either of the two discs can be selected to be driven while the other is fixed. The two discs are driven either by two separate motors, which is very expensive, or alternatively by a common motor for the two discs which can be coupled to one or other of the two discs as required, one of the two discs which is to be turned being simultaneously retained by special means in such a manner that its axis forms the axis of the roatational movement.

With these machines, the ratio of the magnitude of the angle of bending to the number of rotations of the motor is different for each of the two bending directions. Moreover, for this reason, the bending speed at the same speed of rotation of the motor is also different for each of the two bending directions. Finally, at least for one of the two discs, the ratio of the magnitude of the angle of bending to the number of rotations of the motor also varies depending on the diameter of the wire to be bent. Although this dependence can be avoided in the same manner as in the case of the machine first described, if the distances between the axes of the bending tools are not varied as a function of the diameter of the wire, differing angles of advance would result, depending on the diameter of the wire, which would complicate the automatic control of the machine. The angle of advance is that angle through which the bending tool must pass from the position of rest, wherein both bending tools lie in a plane perpendicular to the axis of the wire, until the wire rests on both bending tools and the bending process actually begins.

The object of the invention is to provide a bending machine of the kind described in which a constant relationship always exists between the magnitude of the angle of bending and the number of rotations of the motor, irrespective of the diameter of the wire, and which can therefore be designed to be easily convertible to wires of different diameters, the angle of advance likewise always remaining constant, so that with this machine substantial simplifications are also obtained in respect of control technology as compared with the conventional machines.

In accordance with the invention this object is achieved by a bending machine of the kind described characterised in that a bending control-arm carrying both said bending tools is linked to a second control-arm by means of a pivot pin which is aligned with one said bending tools, said second control-arm in turn being pivotably mounted on a baseplate by means of a journal pin disposed parallel to the axis of said pivot pin, the axis of each of said two bending tools in the position of rest thereof lying in alignment with the axis of a respective one of said pivot and journal pins, and in that there is a drive disc which is rotatable by a mechanical drive, for the purpose of bending, and is adapted to be displaced in a straight line within guides on said baseplate to change the bending direction, said disc being relatively displaceable by means of a dismetrical guide which is coupled, for torque transmission, with said bending control-arm carrying said bending tools.

Further developments of the invention are evident from the description which follows of an exemplary embodiment illustrated in the accompanying drawings, in which.

Figures 1, 2, 3, 4, 5:
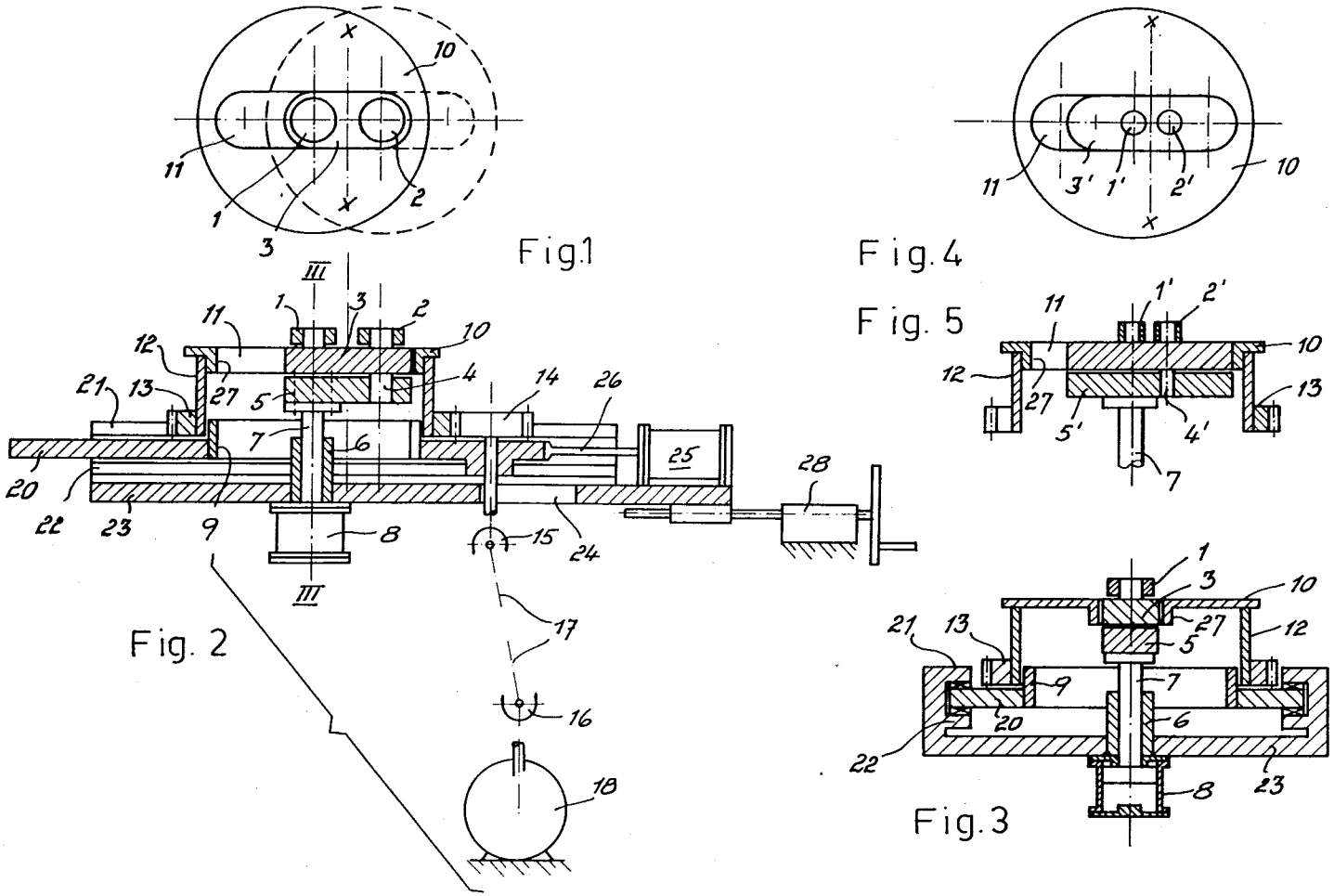
FIG. 1 shows a plan view of the arrangement of the bending tools in a bending machine according to the invention.
FIG. 2 shows a diagrammatic axial section through a bending machine according to the invention, portraying all essential parts thereof.
FIG. 3 is a cross-section taken on the line III—III in FIG. 2.
FIG. 4 is a plan view, similar to FIG. 1, of a bending machine with bending tools designed for smaller wire diameters.
FIG. 5 shows an axial section through a tool unit with bending tools according to FIG. 4 and associated control-arms.

The bending machine according to the invention shown in the drawing possesses, as bending tools, two cylindrical rollers 1 and 2, which are arranged rotatably on one side of a bending control-arm 3. The bending control-arm 3 is provided, on the side opposite to the bending rollers 1, 2, with a cylindrical pivot pin 4, the axis of which lies in alignment with the axis of the bending roller 2. The pivot pin 4 rests rotatably in a drilled hole in a second control-arm 5, which in turn is mounted on the bending machine so as to be pivotable about an axis which, in the parallel position of the control-arms 3, 5, is aligned with the axis of the bending roller 1. Expediently, the second control-arm 5 is attached, in an easily exchangeable manner, by means of screws which are merely indicated by their axes, to a piston rod 7 of a working cylinder 8, this piston rod being guided so as to be rotatable in a bearing 6 and displacement axially.

A drive disc 10 having a guide which runs diametrally serves to drive the bending tools, this guide being formed, in the preferred exemplary embodiment shown, by a longitudinal slot 11 forming a sliding groove for the bending control-arm 3 which, relative to this slot, has the function of a sliding block. This drive disc 10 is fixedly connected to a cylindrical jacket 12, which in turn is fixedly connected at its edge opposite the drive disc to a ring gear 13 and is mounted to be rotatable about a cylindrical ring 9. The ring gear 13 meshes with a gear wheel 14, which can be driven from a motor 18 via universal joints 15, 16, which are merely outlined and a shaft 17 of telescopic construction.

The drive disc 10 with the jacket 12, the ring gear 13 and the gear wheel 14, are mounted on a control plate 20 by means of the cylindrical ring 9. The control plate 20 is slideably guided at its longitudinal edges between guide rails 21, 22. The guide rails 21, 22 are arranged on the two bent-up leg parts of a baseplate 23 of through-like construction. The baseplate 23 also carries the bearing 6 for the piston rod 7 and the cylinder 8. An aperture 24 is provided in the bottom of the baseplate for the shaft driving the gear wheel 14.

Fixed to the baseplate 23 is a working cylinder 25, the piston rod 26 of which engages with the control plate 20. By means of the working cylinder 25, the control plate 20 can be displaced to a limited extent relatively to the baseplate 23 between the guide rails 21, 22, so that the drive disc 10 can be brought into two extreme positions.

The mode of operation of this bending machine is as follows:

In the position of rest, shown in each of FIGS. 1 to 5, of the parts of the machine, the centre-point of the drive disc 10 coincides with the axis of the bending roller 1. At the same time the axis of the bending roller 1 lies in alignment with the axis of the piston rod 7, and the axis of the bending roller 2 in alignment with the axis of the pivot pin 4. The wire to be bent is, for example, drawn off in a conventional manner from a reel, is straightened, and is pushed in between the bending rollers 1 and 2 by means of transporting rollers (not shown) and a wireguide in such a way that the axis of the wire lies on the line X—X in FIG. 1.

If the drive disc 10 is now set in rotation by the motor 18 via the parts 12 to 17, this drive disc rotates about the axis of the bending roller 1, and the wire introduced between the bending tools 1 and 2 is consequently bent around the roller 1 by the active roller 2 which moves about the axis of the roller 1 acting as a bending mandrel.

In order to change the direction of bending, the control plate 20 with all parts attached thereto is displaced by means of the working cylinder 25 in such a way that the drive disc 10 assumes the second extreme position shown in broken lines in FIG. 1. The centre-point of the drive disc 10 now coincides with the axes of the bending roller 2 and of the journal pin 4. When the disc 10 is rotated, the bending roller 1 now pivots about the roller 2, which is now serving as a bending mandrel, and bends the wire about the latter.

After each bending operation the drive disc 10 pivots back into its starting position, in which the two bending rollers 1, 2 are situated in a plane perpendicular to the wire feed line X—X. The wire can subsequently be advanced and then be bent either immediately in the same bending direction again, or in the opposite bending direction after prior displacement of the control plate 20 and all parts carried thereby.

The bent wire can, after the last bending operation, be severed from the stock of wire in a conventional manner by means of a cutter (not shown) located between the wire advancing device and the bending rollers. If the last leg of the bent wire is intended to be shorter than the distance of the cutter from the bending tools, the wire must be retracted before being cut by the cutter. In order that such a backward drawing movement of the bent wire should not be impeded by the bending tools, the bending rollers 1 and 2 can, according to the preferred exemplary embodiment shown, be retracted by the cylinder 8, by means of the bending control-arm 3 and the second control arm 5, out of the bending plane into the longitudinal slot 11. For this purpose, the bending control-arm 3 must be so constructed as to be wider than the diameter of the bending rollers 1 and 2 and, in the axial direction of the piston rod 7, higher than the bending rollers. During this operation the bending control-arm 3 slides on the lateral walls 27 of the shaft-like longitudinal slot 11 of the drive disc 10, the height of which slot in the axial direction of the piston rod 7 is equal to the height of the bending control-arm 3, and hence, even in the fully retracted state, wherein the bending rollers rest entirely within the shaft of the slot 11, still remains in contact with this slot, so that once the control-arms 3 and 5 have again been advanced into the working position the machine is immediately ready for further use.

In order for it to be possible to a bend a wire with a different diameter, the bending control-arm 3 and the second control-arm 5 must be exchanged for another combination of control-arms 3', 5', as is shown in FIGS. 4 and 5. Moreover, the baseplate 23 must be displaced in guides (not shown) in the machine housing by means of a spindle 28 in such a way that the wire feed line X—X defined by the wire-guide solid with the machine, again comes to lie precisely in the centre between the two bending rollers 1' and 2' newly installed together with the control-arms 3', 5'.

The length of the control-arms 3 and 5, the width of which is equal for all control-arms, is so calculated in every case that the drive disc 10 is locked by the bending control-arm against further displacements in both its extreme positions, in which the axis of this drive disc coincides with the axis of one of the two bending rollers 1, 2. The control plate 20 thus always moves, under the action of the cylinder 25, only to the point at which the drive disc 10 butts against one end of the bending control-arm 3, as a result of which a further displacement of the control plate 20 is prevented.

We claim:

1. A bending machine for wire or strip material, comprising a baseplate, two cylindrical bending tools mounted on said baseplate, either of said bending tools being selectable to act as an active bending tool which is pivotable about the position of rest of said other bending tool, said other bending tool then acting as a bending mandrel, a first bending control-arm supporting said bending tools, a second control-arm linked to said first control-arm by means of a pivot pin, said pivot pin being aligned with one of said bending tools, said second control arm being pivotably mounted on said baseplate by means of a journal pin disposed parallel to the axis of said pivot pin, the axis of each of said bending tools in the position of rest lying in alignment with the axis of a respective one of said pivot and journal pins, and a drive disc rotatably mounted on said baseplate, said drive disc being displaceable by a piston in a straight line within guides between two operative positions in each of which the center of rotation of said drive disc coincides with the axis of one of said bending tools in order to change the bending direction, said drive disc having a diametrical guide which is coupled with said first control-arm supporting said bending tools for transmission of torque to said bending tools.

2. The machine of claim 1 wherein said diametrical guide on said drive disc is a longitudinal slot forming a sliding groove for receiving said first bending control-arm therein and wherein said drive disc is displaceable with respect to said first bending control-arm in said slot.

3. A machine according to claim 1, wherein said two mutually linked control-arms together with said bending tools are modular units and may be interchanged to correspond to different wire thicknesses.

4. A machine according to claim 3, characterised in that a device is provided for the relative displacement of said bending tools, in the state of rest thereof, relative to a feed axis of said material to be bent, when said tool units are exchanged.

5. A bending machine for wire or strip material, comprising a baseplate, two cylindrical bending tools mounted on said baseplate, either of said bending tools being selectable to act as an active bending tool which is pivotable about the position of rest of said other bending tool, said other bending tool then acting as a bending mandrel, a first bending control-arm supporting said bending tool, a second control-arm linked to said first control-arm by means of a pivot pin, said pivot pin being aligned with one of said bending tools, said second control arm being pivotably mounted on said baseplate by means of a journal pin disposed parallel to the axis of said pivot pin, the axis of each of said bending tools in the position of rest lying in alignment with the axis of a respective one of said pivot and journal pins, and a drive disc rotatably mounted on said baseplate, the drive disc being displaceable by a piston in a straight line within guides between two operative positions in each of which the center of rotation of said drive disc coincides with the axis of one of said bending tool in order to change the bending direction, said drive disc having a diametrical guide which is coupled with said first control-arm supporting said bending tool for transmission of torque to said bending tools, wherein said diametrical guide on said drive disc is a longitudinal slot forming a sliding groove for receiving said first bending control-arm therein, and wherein said drive disc is displaceable with respect to said first bending control-arm in said slot.

6. A machine according to claim 5, characterised in that said bending control-arm has a width which is greater than the diameters of said bending tools and, measured in the axial direction of said journal pin, higher than said bending tools, in that walls are provided in said longitudinal slot which provide a shaft, the depth of which is equal to the height of said bending control-arm, and in that said journal pin of said second control-arm is so constructed as to be displaceable axially whereby said two bending tools can be retracted by means of said journal pin and of said two control-arms into said longitudinal slot of said drive disc, permanent engagement of said bending control-arm with said walls of said longitudinal slot being retained.

7. A machine according to claim 5, characterised in that, for the purpose of at least one of displacing said drive disc in a straight line and adjusting said journal pin of said second control-arm axially, respective working cylinders are provided.

* * * * *